United States Patent [19]

Stonhaus

[11] 4,254,927

[45] Mar. 10, 1981

[54] JACKING PLATE FOR TRAILER AND THE LIKE

[76] Inventor: James H. Stonhaus, P.O. Box 4097, Fresno, Calif. 93744

[21] Appl. No.: 34,829

[22] Filed: Apr. 30, 1979

[51] Int. Cl.[3] ..... A47B 91/00

[52] U.S. Cl. ..... 248/346; 248/357

[58] Field of Search ..... 248/346, 346.1, 357; 254/1, DIG. 1

[56] References Cited

U.S. PATENT DOCUMENTS

| | | | |
|---|---|---|---|
| 2,929,601 | 3/1960 | Anderson | 248/346 |
| 2,931,463 | 4/1960 | Stansbury | 248/346.1 X |
| 4,048,776 | 9/1977 | Sato | 248/346 |

FOREIGN PATENT DOCUMENTS

| | | | |
|---|---|---|---|
| 2222970 | 11/1973 | Fed. Rep. of Germany | 248/346 |

*Primary Examiner*—J. Franklin Foss

*Attorney, Agent, or Firm*—Townsend and Townsend

[57] ABSTRACT

A plate for providing a jacking pad for trailer and camper jacks is disclosed which includes a square plate. Plate reinforcing flanges integral with the square plate are provided to distribute loading and prevent plate breakage from occurring. These same plate reinforcing flanges are routed so as to provide capture points for preventing sliding of three common types of trailer jacks; these jacks including a square base jack, a pivot point jack and a trailer third wheel. Serendipitiously, routing of the jack capturing flangeways is provided so as to resist lines of breakage that might otherwise occur.

1 Claim, 6 Drawing Figures

JACKING PLATE FOR TRAILER AND THE LIKE

BACKGROUND OF THE INVENTION

This invention relates to a plate for stabilizing a trailer jack on soft ground.

SUMMARY OF THE PRIOR ART

Trailers that are moved and jacked on other than firm ground settle. Since jacking points, unlike tires, occupy small concentrated areas, the force per square inch is relatively high with the result that settlement occurs.

Typically, such settlement occurs when least desired—that is when the trailers are occupied after being parked or wherein additional occupants (such as guests) cause dynamic loading.

Placing boards, plates and other materials under jacks is known. However, fracture and/or bending of the plates occurs. Moreover, relative movement between the jack on one hand and the ground mounted plate on the other often times imparts a sliding movement. Sliding movement in trailers can be dangerous.

SUMMARY OF THE INVENTION

A plate for providing a jacking pad for trailer and camper jacks is disclosed which includes a square plate. Plate reinforcing flanges integral with the square plate are provided to distribute loading and prevent plate breakage from occurring. These same plate reinforcing flanges are routed so as to provide capture points for preventing sliding of three common types of trailer jacks; these jacks including a square base jack, a pivot point jack and a trailer third wheel. Serendipitiously, routing of the jack capturing flangeways is provided so as to resist lines of bending and breakage that might otherwise occur.

OTHER OBJECTS AND ADVANTAGES OF THE INVENTION

An object of this invention to disclose the jacking plates with points of plate reinforcement routed so as to provide capturing of jacks. In accordance with this invention, a typically square plate is provided with an immediate and peripheral square flangeway inset from the plate periphery. Interior of the square flangeway there resides a second and circular flangeway. The plate configuration enables the square flangeway to be received interiorly of a typical square trailer jack and jacks with point loading such as camper support rods or trailer third wheels to be received interiorly of the circular plate reinforcing flangeway.

An advantage of this invention is that jacks, when resting on the plate, are captured thereon. Thus, a differential settlement of one side of the plate relative to the other on soft ground will not cause a metal-to-metal sliding interface. Where there is differential settlement on the plate in the prior art sliding is frequently promoted.

A further result of this invention is that the jack capturing flangeways at the same time serve to increase at critical points the depth of the plate. The plate is in effect reinforced with integrally cast flanges.

A further advantage of the particular flangeway herein described is that a circular flangeway immediately surrounds the plate at areas where point loading occurs. The propagation of stresses which may lead to plate cracking and/or bending is resisted by the circular flangeway. This resistance to stress propagation occurs because the circular flange does not include abrupt change of direction with resultant stress concentration.

Other objects, features and advantages of this invention will become more apparent after referring to the following specification and attached drawings in which:

DESCRIPTION OF THE PREFERRED EMBODIMENTS

Figure 1:
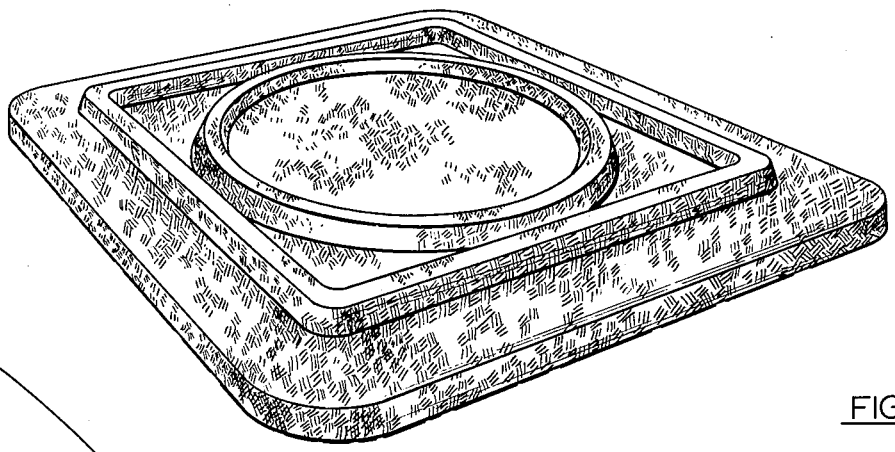
FIG. 1 is a perspective view of the plate of this invention.
Figure 2:
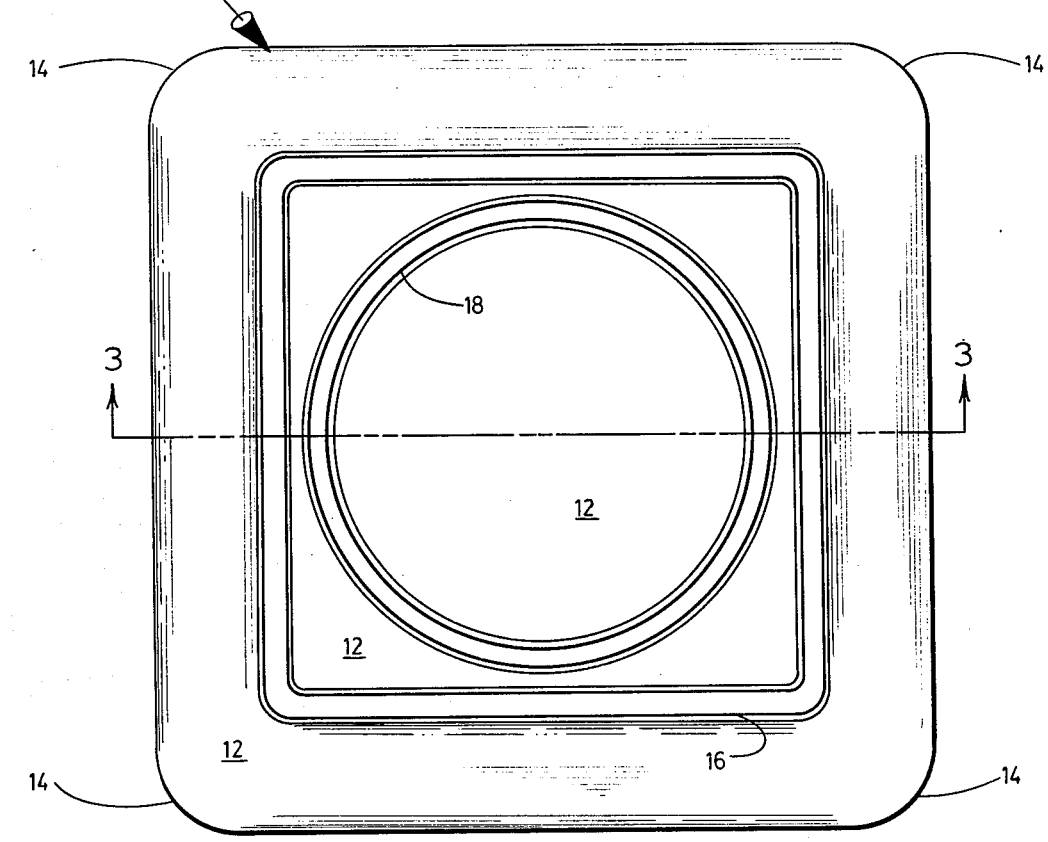
FIG. 2 is a top plan view of the plate of this invention.
Figure 3:
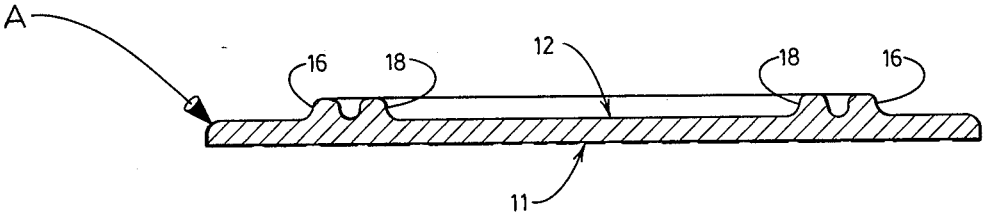
FIG. 3 is a side evaluation taken along lines 3—3 of FIG. 2.

Referring to FIGS. 1–3, the overall configuration of the jack reinforcing plate can be understood.

Plate A consists preferably of a diecast aluminum plate square in configuration. The plate is approximately $\frac{1}{4}''$ thick and includes rounded corners 14. It will be understood that the entirety of the plate maintains the same thickness from edge to edge. Plate bottom 11 confronts the ground; plate top 12 is upward and exposed. This surface receives loading and is the surface from which reinforcing flanges are formed.

Inset from the edge of plate A there is provided a plate reinforcing flange 16, which is of square configuration. The reinforcing flange typically is the same thickness as plate A, so that plate A at the point of flange 16 is twice its ordinary thickness. Flange 16 is typically formed integrally to plate 16.

Interiorly of the plate there is provided a circular reinforcing ridge or flange 18. Circular reinforcing ridge 18 has the same overall dimension in height as flange 16. This plate reinforcing flange 18, however, has a different configuration with respect to the periphery of the plate. It is circular and not square.

It will be noted that the two respective flanges are separate. There is no common point of intersection between them. Moreover, all flanges and plate corners are provided with suitable fillets and rounded portions to provide minimum tendency to generate fracture points.

The function of the flanges may be briefly set forth. By providing integrally with the plate an expanded section, improved resistance to plate bending and/or failure is provided.

Figure 4:
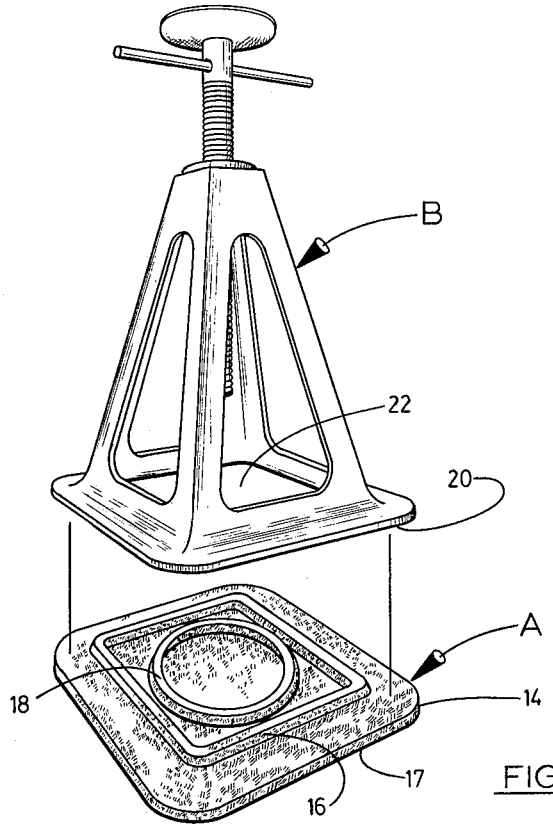
FIG. 4 shows in an exploded juxtaposition, a typical trailer jack having a square base overlying the jacking plate of this invention.

Referring to FIG. 4, the cooperation of the square flange 16 to receive an overlying trailer jack B is disclosed.

Jack B is a typical standard item of manufacture. It provides a base 20, which is square in configuration. Defined centrally of the jack B is an internal square void 22.

Referring to FIG. 4 it can be seen that jack B fits plate A between flange 16 and the periphery 17 thereof. When this fit occurs, flangeway 16 serves to prevent relative movement between the plate A and the bottom of jack B.

At the same time, flange 16 prevents any appreciable relative movement of plate A relative to the bottom of jack B. Even if settlement does occur, the plate and jack will settle together with the tendency to provide an even and more balanced settlement that will not dispose the jack at an angle where falling of the jack and trailer may occur.

Figure 5:
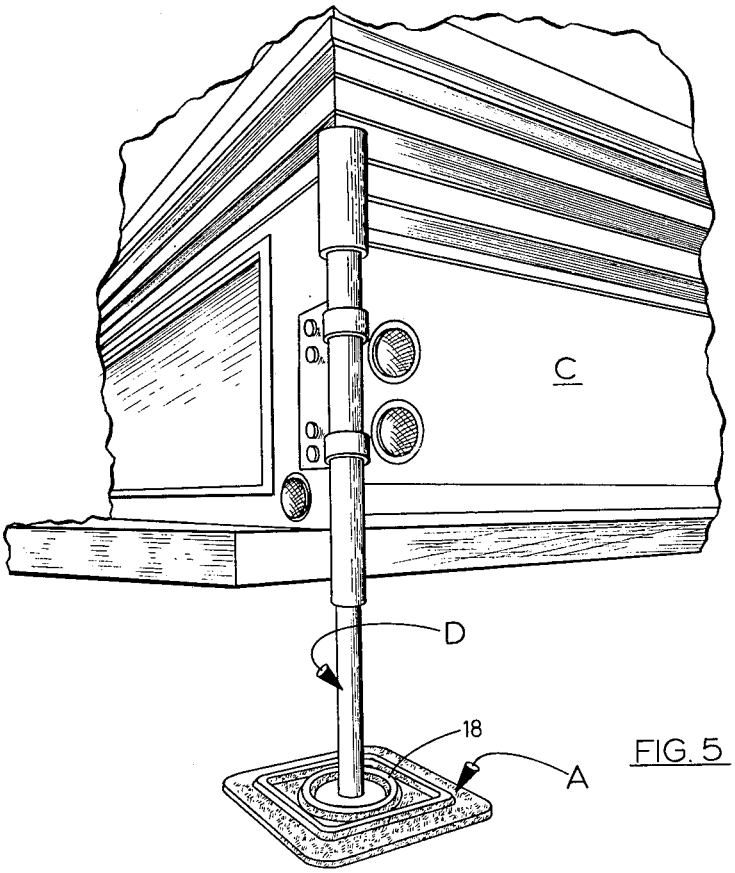
FIG. 5 shows a camper jack having a point loading source landed on the plate of this invention; and, FIG. 6 illustrates a trailer third wheel on the plate of this invention.
Figure 6:
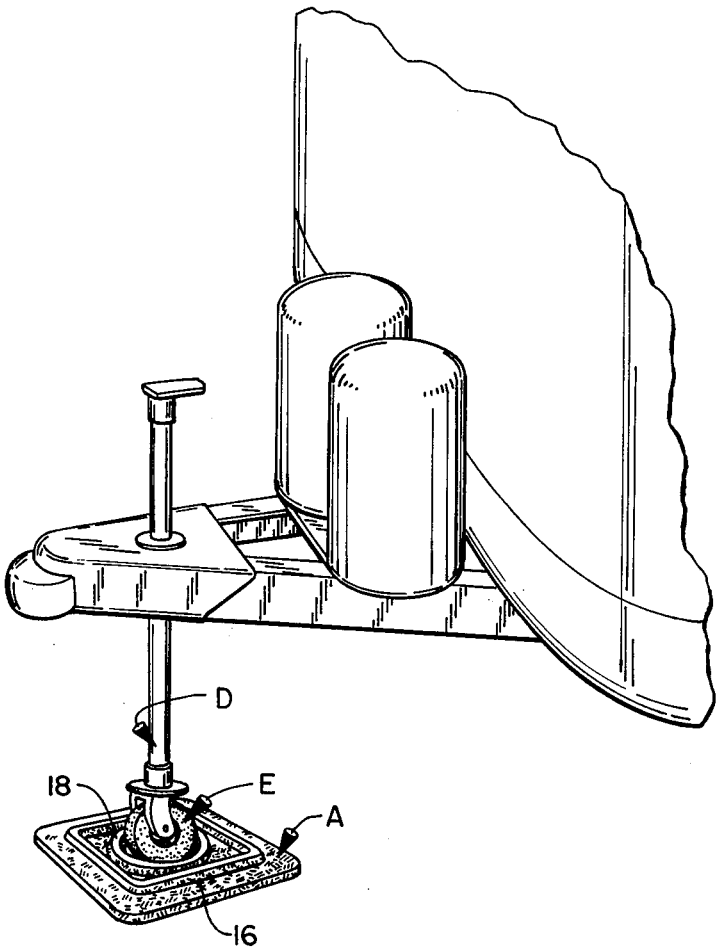

Referring briefly to FIGS. 5 and 6, the understanding of the resistance of point loading by the plate of this invention can be understood.

In FIG. 5, the corner of the camper body C, such as those supported on pick-up trucks is provided with a camper pipe jack D. Camper pipe jack D is shown in an engagement with the plate A of this invention, having the pipe D interiorly of the circular flange 18. Likewise, and with reference, to FIG. 6, a camper third wheel E is shown in engagement with the plate A interior of the circular flange 18.

In both the cases of the pipe jack D and the third wheel E, the circular ridge 18 serves to prevent relative movement between the plate A and the supported jack or wheel. Additionally, it will be realized that by their very nature, both the pipe jack D and the third wheel E tend to concentrate loading at a narrow portion of the plate. Absent reinforcement, plate cracking or bending will typically propagate from the point of loading.

Should the plate had only been manufactured with the square ridge hereon, such propagation of either bending or cracking would tend to concentrate at the plate corners and flange corners. Circular flange 18, however, prevents such propagation of cracking to the corners of flange 16. Thus, all points of plate loading are resisted uniformly by the circular boundary. Simply stated, the circular boundary 18 interior of the square boundary 16 has been found to be an unique barrier which prevents propagation of bending and stress forces.

What is claimed is:

1. A support plate, having an upper and a lower face, for placement between the ground at the lower portion thereof and either a square base jack or a point loading support, such as a trailer third wheel, on the upper face thereof, said support plate comprising: a square plate having a generally flat lower face; a first load receiving area inset from the periphery of said square plate on the upper face thereof; a square flange set on the inside of said first load receiving area so as to circumscribe the inner perimeter of said first load receiving area, said first load receiving area sized for placement of said square base jack thereon; a circular flange, said circular flange interior of said first load receiving area; a second load receiving area interior of said circular flange, said second load receiving area for placement of said point loading support thereon; whereby said respective flanges impart strength to said plate and prevent a load on either said load receiving areas from sliding over the surface of said plate.

* * * * *